US007496310B2

(12) United States Patent
Dan

(10) Patent No.: US 7,496,310 B2
(45) Date of Patent: Feb. 24, 2009

(54) IMAGE FORMING APPARATUS INCLUDING A FIXING ROLLER

(75) Inventor: Kenichi Dan, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 194 days.

(21) Appl. No.: 11/407,290

(22) Filed: Apr. 20, 2006

(65) Prior Publication Data

US 2006/0239706 A1 Oct. 26, 2006

(30) Foreign Application Priority Data

Apr. 21, 2005 (JP) ..... 2005-124026

(51) Int. Cl.
*G03G 15/20* (2006.01)
*G03G 15/00* (2006.01)

(52) U.S. Cl. ..... 399/70; 399/392

(58) Field of Classification Search ..... 399/70, 399/392

See application file for complete search history.

(56) References Cited

U.S. PATENT DOCUMENTS 4,349,269 A * 9/1982 Okada ..... 399/69
5,206,694 A * 4/1993 Ohira et al. ..... 399/33
5,426,494 A 6/1995 Muto et al.

FOREIGN PATENT DOCUMENTS

| | | |
|---|---|---|
| JP | H3 122672 | 5/1991 |
| JP | H5 4762 | 1/1993 |
| JP | H6 102718 | 4/1994 |
| JP | H7 191592 | 7/1995 |
| JP | H10 45269 | 2/1998 |
| JP | 2002311792 A * | 10/2002 |

* cited by examiner

*Primary Examiner*—David M Gray
*Assistant Examiner*—Erika J. Villaluna
(74) *Attorney, Agent, or Firm*—Baker Botts, LLP

(57) ABSTRACT

An image forming apparatus that includes a fixing roller to fix a developer onto a recording medium, a heating unit to heat the fixing roller, a manual feed roller disposed at a position contact with a top end of the recording medium inserted into a manual feed port and capable of holding and feeding the recording medium, a common driving unit that drives the fixing and manual feed rollers together, a judgment unit to judge whether a temperature of the fixing roller is lower than a first temperature capable of starting image formation and reaches a second temperature higher than a melting point of the developer, a detection unit to detect whether the recording medium is inserted, and a control unit to control the driving unit to drive the manual feed roller to hold the recording medium if the recording medium is detected and the temperature reaches the second temperature.

6 Claims, 9 Drawing Sheets

IMAGE FORMING APPARATUS INCLUDING A FIXING ROLLER

CROSS REFERENCE TO RELATED APPLICATION

The application claims priority from Japanese Patent Application No. 2005-124026, filed Apr. 21, 2005, the contents of which are hereby incorporated by reference into the present application.

TECHNICAL FIELD

Aspects of the present invention relate to an image forming apparatus.

BACKGROUND

Conventionally, an image forming apparatus capable of manual paper feed has been provided. For example, JP-A-5-4762 discloses a printer with a paper feeding device that can hold paper fed into manual feed port by rotating a feed roller on detecting insertion of paper into a manual feed port. Because an user does not need to hold paper while the paper is fed through the manual feed port, the printer is easy to feed paper and convenient to use.

In order to reduce a cost, it is effective to drive the manual feed roller and a fixing roller by the same driving source. However, if the manual feed roller is driven in an early stage, the fixing roller is rotated before the fixing roller is heated enough and reaches the fixing temperature. Such an apparatus has a problem in the fixing roller due to low temperature drive, such as a large torque by driving where developer is not molten and a deterioration of temperature detection means. If the manual feed roller is driven after the fixing roller reaches the fixing temperature, the apparatus is less convenient due to long waiting time.

The invention provides a structure in which the waiting time is effectively reduced without nonconformity in the manual feed of a recording medium.

SUMMARY

According to one aspect of the present invention, there is provided an image forming apparatus that includes a fixing roller to fix a developer onto a recording medium, a heating unit to heat the fixing roller, a manual feed roller that is disposed at a position contact with a top end of the recording medium inserted into a manual feed port, and is capable of holding and feeding the recording medium, a common driving unit that drives the fixing roller and the manual feed roller together when driving the manual feed roller, a judgment unit to judge whether a temperature of the fixing roller is lower than a first temperature capable of starting image formation and reaches a second temperature higher than a melting point of the developer, a detection unit to detect whether the recording medium is inserted into the manual feed port, and a control unit to control the driving unit to drive the manual feed roller to hold the recording medium by the manual feed roller if the recording medium is detected by the detection unit and the judgment unit judges that the temperature of the fixing roller reaches the second temperature.

DETAILED DESCRIPTION OF ILLUSTRATIVE ASPECTS

An illustrative aspect of the present invention will be described with reference to the drawings.

1. Overall Structure

Figure 1:
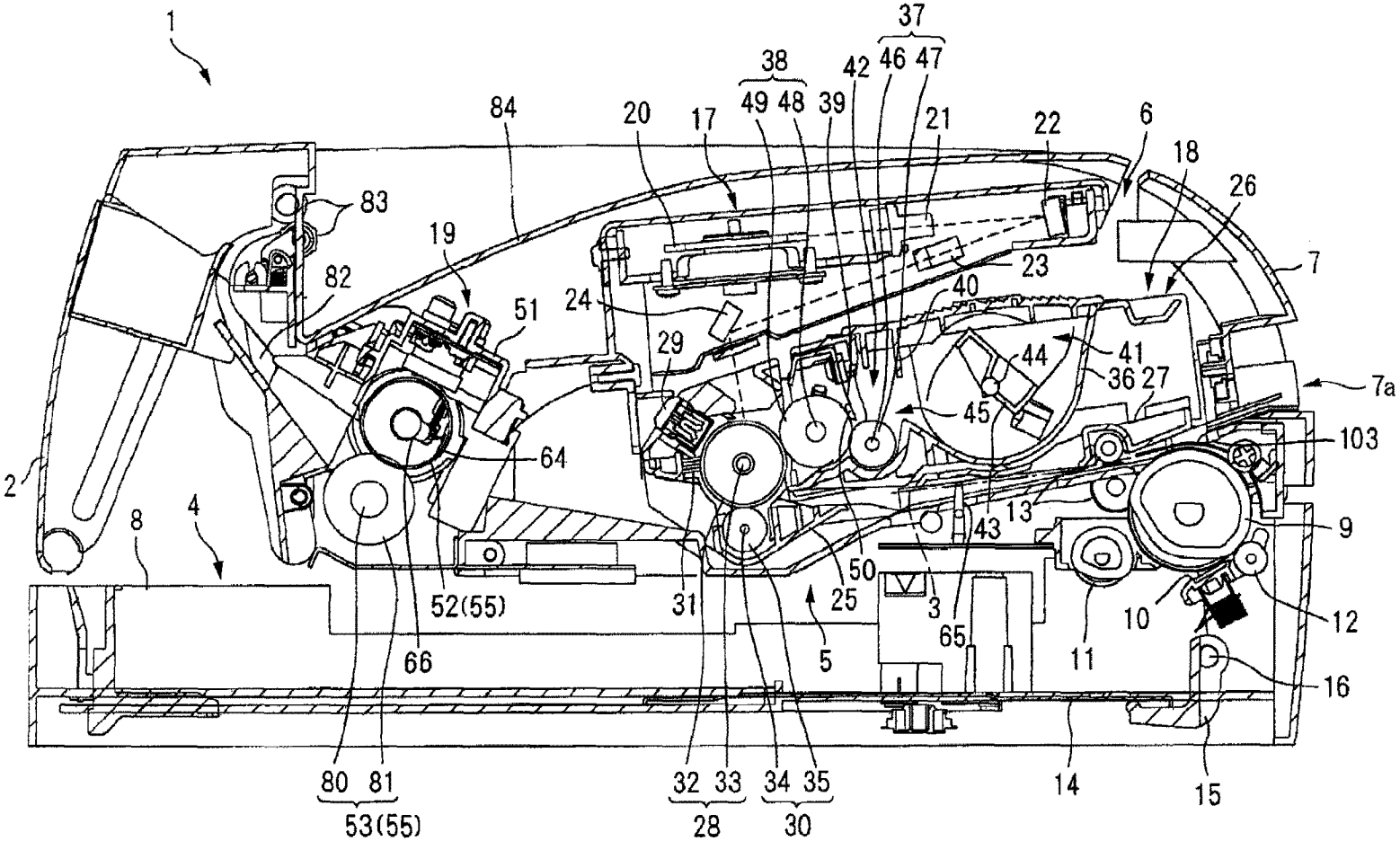
FIG. 1 is an essential side cross-sectional view illustrating a laser printer according to an illustrative aspect.
Figure 2:
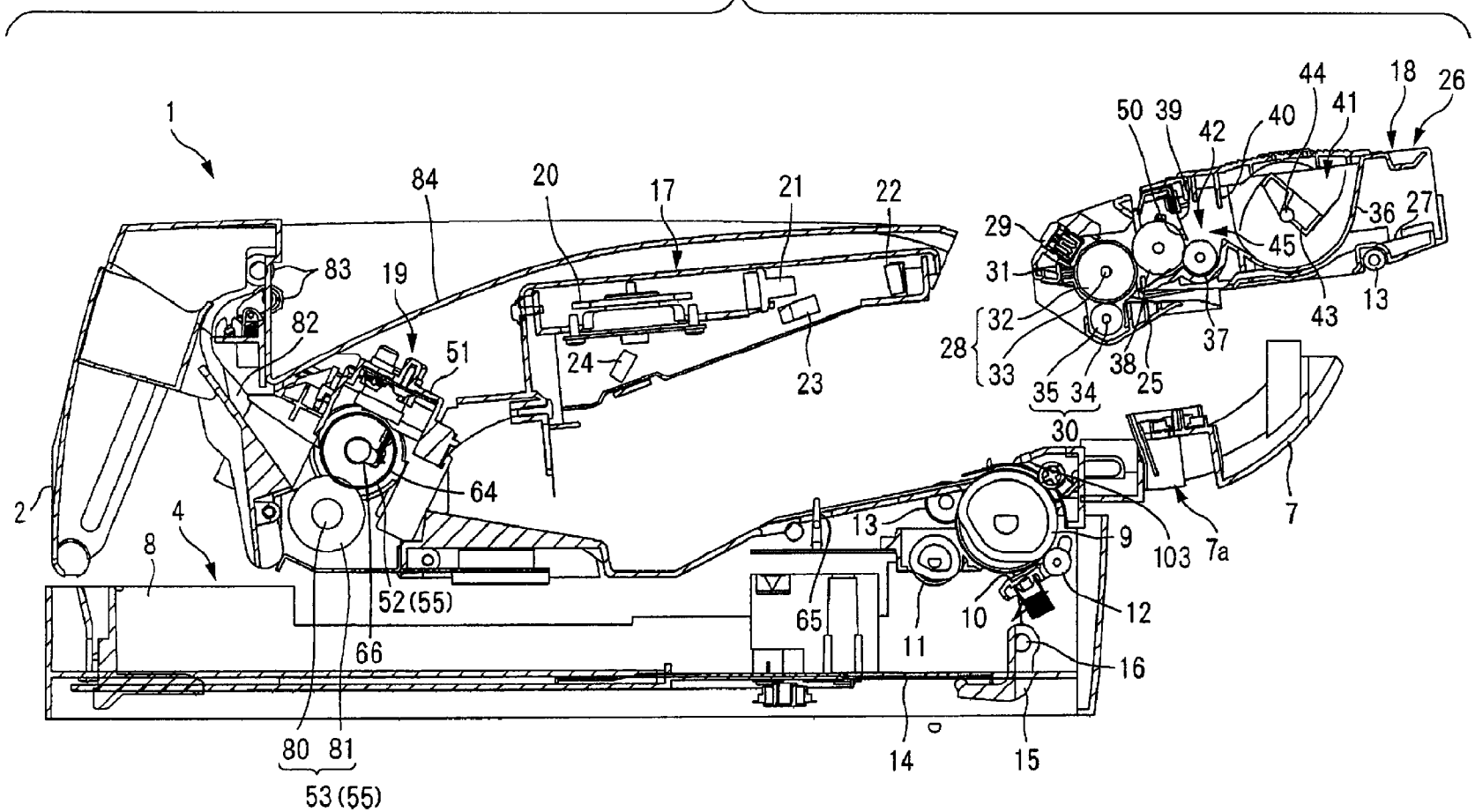
FIG. 2 is an essential side cross-sectional view showing a state where a front cover of the laser printer is open.

FIGS. 1 and 2 are essential side cross-sectional views showing a laser printer as an image forming apparatus according to an illustrative aspect of the invention. The laser printer 1 includes a feeder section 4 for feeding paper 3 as a recording medium and an image forming section 5 for forming an image on the fed paper 3 in a main body casing 2.

In the main body casing 2, an insert/eject port section 6 for inserting/ejecting a process cartridge 18 is formed on one sidewall, and a front cover 7 for opening/closing the insert/eject port section 6 is provided.

The front cover 7 is supported freely rotatably around a cover shaft (not shown) inserted into a lower end thereof. When the front cover 7 is closed, the insert/eject port section 6 is closed by the front cover 7, as shown in FIG. 1. When the front cover 7 is opened, the insert/eject port section 6 opens, and the process cartridge 18 is inserted/ejected to/from the main body casing 2, as shown in FIG. 2.

In the following, for the laser printer 1 and the process cartridge 18 (including a development cartridge 26 as will be described later), a side where the front cover 7 is provided is defined as "front side", and an opposite side is defined as "back side".

A feeder section 4 includes, on a bottom part of the main body casing 2, a paper feed tray 8 attached detachably, a paper feed roller 9 and a separation pad 10 provided above an front-end of the paper feed tray 8, a pickup roller 11 provided in a rear of the paper feed roller 9, a pinch roller 12 disposed oppositely in a lower part on a front side of the paper feed roller 9, and a registration roller 13 provided in an upper part on a back side of the paper feed roller 9.

A paper pressing plate 14 for laying paper 3 is provided in the paper feed tray 8. The paper pressing plate 14 is supported swingably at rear-end thereof, and a front-end can be moved vertically.

Also, a lever 15 for lifting the front-end of the paper pressing plate 14 upward is provided at a front-end of the paper feed tray 8. The lever 15 has an L-shaped cross section to turn round from the front side to the lower side of the paper pressing plate 14, the upper end being attached to a lever shaft 16 provided at the front-end of the paper feed tray 8, and the rear-end being contacted with the front-end on the lower face of the paper pressing plate 14. When a rotational driving force in a clockwise direction in the drawing is applied to the lever shaft 16, the lever 15 rotates around the lever shaft 16 as fulcrum, and the rear-end of the lever 15 lifts the front-end of the paper pressing plate 14.

When front-end of the paper pressing plate 14 is lifted, a paper 3 on the top of the paper pressing plate 14 is pressed on the pickup roller 11, and is fed between the paper feed roller 9 and the separation pad 10 along with the rotation of the pickup roller 11.

When the paper feed tray 8 is detached from the main body casing 2, the rotation drive shaft inserted in the lever shaft 16 is ejected, and the front-end of the paper pressing plate 14 moves downward owing to the weight to lie on a bottom face of the paper feed tray 8. The paper 3 is laid on the paper pressing plate 14.

When the paper 3 fed between the paper feed roller 9 and the separation pad 10 by the pickup roller 11 is sandwiched between the paper feed roller 9 and the separation pad 10 along with rotation of the paper feed roller 9, the paper is securely handled one by one and fed. The paper 3 is passed between the paper feed roller 9 and the pinch roller 12 and fed to a registration roller 13.

The registration roller 13 includes a pair of rollers opposed to each other, and feeds the paper 3 after align to a transfer position of the image forming section 5, which is a nip position between a photosensitive drum 28 and a transfer roller 30 where the toner image on the photosensitive drum 28 is transferred onto the paper 3.

A detecting section 65 is disposed between the registration roller 13 and the transfer position on a feeding path of the paper 3. The detecting section 65 detects mechanically the paper 3. When a lever included in the detecting section 65 contacts with and is pressed by the paper 3, the lever is moved from a predetermined position.

The image forming section 5 includes a scanner section 17, a process cartridge 18 and a fixing section 19.

The scanner section 17 is provided in the upper part of the main body casing 2, and includes a laser light source (not shown) a polygon mirror 20 driven and rotated, an fθ lens 21, a reflecting mirror 22, a lens 23 and a reflecting mirror 24. A laser beam according to an image data emitted from the laser light source is deflected by the polygon mirror 20, passed through the fθ lens 21, bent back by the reflecting mirror 22, passed through the lens 23, bent down by the reflecting mirror 24, and irradiated by fast scanning on a surface of a photosensitive drum 28 for the process cartridge 18, as indicated by broken line in FIG. 1.

The process cartridge 18 is detachably attached under the scanner section 17 on the main body casing 2. The process cartridge 18 includes a drum cartridge 25 and a development cartridge 26 detachably attached on the drum cartridge 25.

The drum cartridge 25 includes a development cartridge 26 on a front side, and a photosensitive drum 28, a Scorotron type charger 29, a transfer roller 30 and a cleaning brush 31 on a back side between a pair of side plates 27. The drum cartridge 25 extends in a longitudinal direction of the main body casing 2. The side plates 27 are opposed to each other in a width direction orthogonal to the longitudinal direction of the main body casing 2.

The photosensitive drum 28 includes a cylindrical drum main body 32 formed of a positively charged photosensitive layer, the uppermost layer being made of polycarbonate and a metallic drum shaft 33 extending along a longitudinal direction of the drum main body 32 through a shaft center of the drum main body 32. The drum shaft 33 is supported unrotatably by both side plates 27 of the drum cartridge 25, and the drum main body 32 is supported rotatably around the drum shaft 33. The photosensitive drum 28 is rotatable around the drum shaft 33 between both side plates 27.

The Scorotron type charger 29 is disposed obliquely upward in the rear of the photosensitive drum 28 separated from the photosensitive drum 28. The Scorotron type charger 29 is positively charged to generate a corona discharge from a charging wire of tungsten or the like, and positively charges the surface of the photosensitive drum 28 uniformly.

The transfer roller 30 is supported rotatably by both side plates 27 of the drum cartridge 25, and disposed to contact the photosensitive drum 28 from vertically beneath to form a nip with the photosensitive drum 28. The transfer roller 30 has a metallic roller shaft 34 covered with a roller 35 made of conductive rubber material. A transfer bias is applied to the transfer roller 30.

The cleaning brush 31 is disposed in the rear of the photosensitive drum 28 wherein a tip of a brush contacts a surface of the drum main body 32 of the photosensitive drum 28.

The development cartridge 26 is detachably attached on the drum cartridge 25, and includes a box-shaped housing 36 with a rear side opened, which has a supply roller 37, a development roller 38 and a layer thickness regulating blade 39.

A partition plate 40 projecting downwardly from an upper face of the housing 36 extends in the width direction. A toner storage chamber 41 is provided in front of the partition plate 40, and a development chamber 42 is provided behind the partition plate 40.

The toner storage chamber 41 includes positively chargeable, non-magnetic one component toner. The toner is obtained by copolymerizing a polymeric monomer (for example, styrene monomer such as styrene, or acrylic monomer such as acrylic acid, alkyl (C1 to C4) acrylate or alkyl (C1 to C4) methacrylate) by a well-known polymerization method such as suspension polymerization. The polymer toner is spherical, and has excellent flow property to form an image of high quality.

Coloring agent such as carbon black or a wax is blended into the toner, and additive agent such as silica is added to improve the flow property. A particle radius is 6 to 10 μm.

An agitator 43 for agitating the toner in the toner storage chamber 41 is provided in the toner storage chamber 41. The agitator 43 is supported around an agitator rotation shaft 44 extending in the width direction in a central part of the toner storage chamber 41, and rotates, so that the toner in the toner storage chamber 41 is agitated and discharged through a toner discharge port 45 below the partition plate 40 to the development chamber 42.

A supply roller 37 is disposed in a lower part on a front side in the development chamber 42, and supported rotatably between both side plates opposed in the width direction of the housing 36. The supply roller 37 includes a metallic supply roller shaft 46 extending in the width direction and a sponge roller 47 made of conductive foaming material covering a periphery of the supply roller shaft 46.

The development roller 38 is disposed in a lower part on a backside in the development chamber 42 and supported rotatably between both side plates opposed in the width direction of the housing 36. A part of the surface of the development roller 38 projects rearward from the housing 36. The development roller 38 contacts the photosensitive drum 28 in the longitudinal direction wherein the development cartridge 26 is mounted on the drum cartridge 25. The development roller 38 includes a metallic development roller shaft 48, and a rubber roller 49 covering a periphery of the development roller shaft 48. The rubber roller 49 is made of conductive urethane rubber or silicone rubber including carbon particle, the surface covered with fluorine containing urethane rubber or silicone rubber. Also, the rubber roller 49 contacts with a sponge roller 47 of the supply roller 37 compressed against each other.

The layer thickness regulating blade 39 includes a metallic leaf spring member, and a pressing rubber member 50, having a semicircular cross section, made of insulating silicone rubber. The layer thickness regulating blade 39 is supported by the housing 36 above the development roller 38, the lower end being opposed to the rubber roller 49 of the development roller 38 from a front side. The pressing rubber member 50 is pressed against the rubber roller 49 by the layer thickness regulating blade 39.

The toner discharged from the toner discharge port 45 into the development chamber 42 by rotation of the agitator 43 is supplied on the rubber roller 49 of the development roller 38 by rotation of the supply roller 37. The toner is positively charged by friction between the sponge roller 47 of the supply roller 37 and the rubber roller 49 of the development roller 38. The toner enters between the pressing rubber member 50 of the layer thickness regulating blade 39 and the rubber roller 49 by rotation of the development roller 38, and is supported in as on the rubber roller 49 a thin layer having a certain thickness.

On the other hand, a surface of the photosensitive drum 28 is positively charged by the Scorotron type charger 29 uniformly, and exposed by fast scanning of the laser beam from the scanner section 17 to form an electrostatic latent image according to the image data.

The positively charged toner carried on the rubber roller 49 of the development roller 38 contacts the photosensitive drum 28 by rotation of the development roller 38, and is supplied to the electrostatic latent image formed on the surface of the photosensitive drum 28, i.e. a lower potential portion exposed by the laser beam on the surface of the photosensitive drum 28. The toner is selectively carried to make a visible image, and form a toner image by reversal development.

Thereafter, the photosensitive drum 28 and the transfer roller 30 are driven and rotated to hold and feed the paper 3, and the toner image carried on the surface of the photosensitive drum 28 is transferred onto the paper 3.

The paper dust adhering to the surface of the photosensitive drum 28 according to contact with the paper 3 is removed by a cleaning brush 31 after transfer, when the surface of the photosensitive drum 28 is opposed to the brush.

The fixing section 19 includes a fixing frame 51 provided on a back side of the process cartridge 18 and extending in the width direction, and a heating roller 52 and a pressing roller 53 supported rotatably on the fixing frame 51 and disposed oppositely to each other vertically. The heating roller 52 and the pressing roller 53 are referred to as a fixing roller 55.

The heating roller 52 includes a metallic element tube 64 as a cylindrical member, and has a halogen lamp along an axial direction. The surface of the heating roller 52 is heated to a fixing temperature by the halogen lamp 66.

The pressing roller 53 includes a metallic pressing roller shaft 80 and a rubber roller 81 made of rubber material covering a periphery of the pressing roller shaft 80. The pressing roller 53 is rotated following rotation of the heating roller 52, elastically pressed by the metallic element tube 64 of the heating roller 52.

The fixing unit 19 thermally fixes the toner transferred on the paper 3 during passing between the heating roller 52 and the pressing roller 53, as shown in FIG. 1. The paper 3 is fed to a paper ejecting path 82 extending vertically toward an upper face of the main body casing 2. The paper 3 is ejected to a paper catch tray 84 provided on the upper face of the main body casing 2 by a paper ejecting roller 83 provided at the upper end on the path.

2. Electrical Configuration

Figure 3:
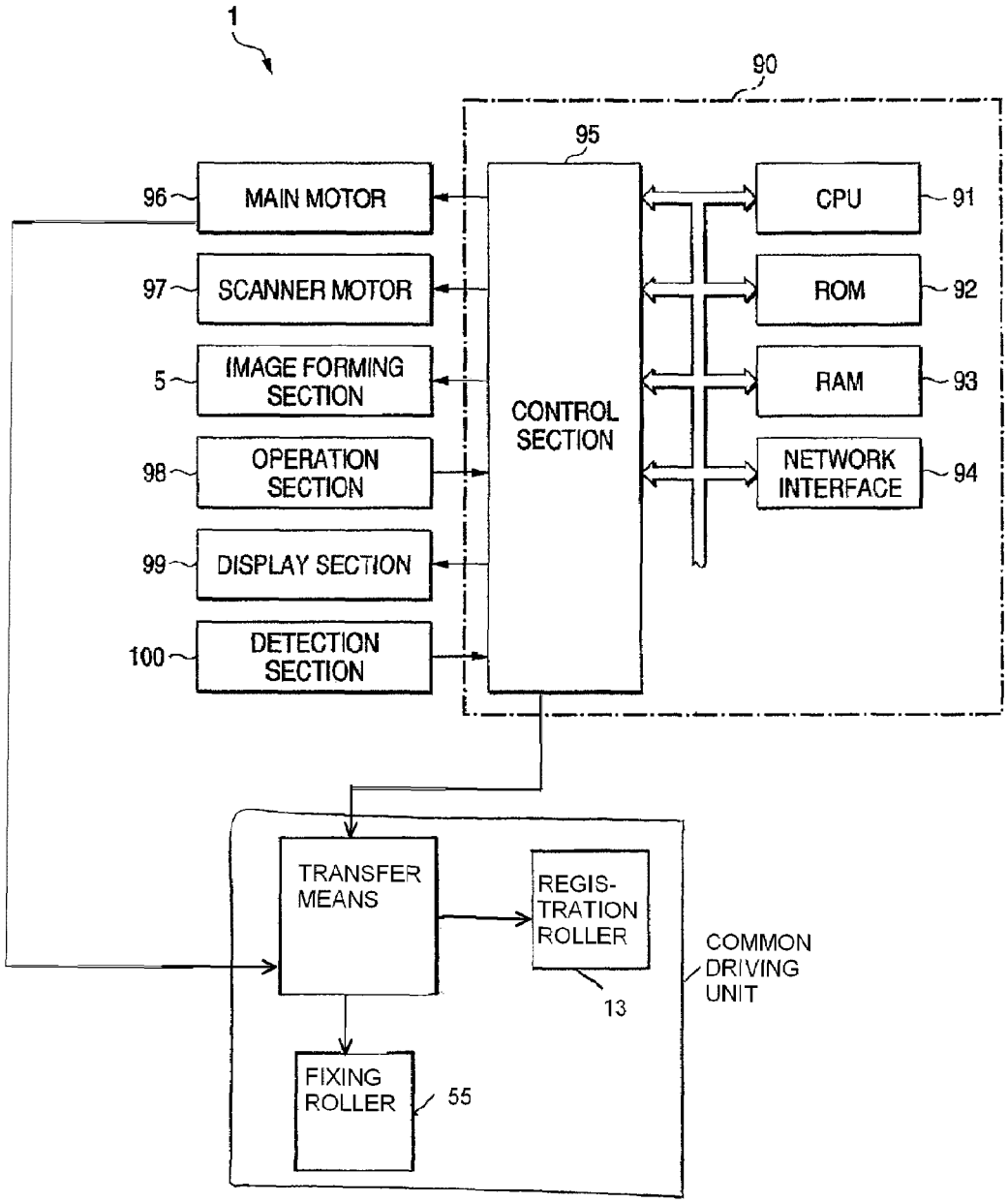
FIG. 3 is a block diagram illustrating a configuration is of an image forming system.

The electrical configuration of the laser printer 1 according to the illustrative aspect will be described. FIG. 3 is a block diagram showing conceptually the electrical configuration of the laser printer 1.

The laser printer 1 has a control unit 90 for controlling components with a control section 95 including a CPU 91, a ROM 92, a RAM 93 and an ASIC (Application Specific Integrated Circuit), as shown in FIG. 3. The control section 95 is electrically connected to an operation section 98 including a main motor 96, a scanner motor 97 and an input panel, a display section 99 including a lamp, and a detection section 100 including a detector.

The ROM 92 and RAM 93 are connected to the CPU 91, which controls each component through the control section 95 in accordance with a processing procedure stored in the ROM 92, and stores a result of processing in the RAM 93.

The main motor 96 rotates synchronously the photosensitive drum 28, the transfer roller 30, the fixing roller 55, and the registration roller 13. The scanner motor 97 rotates the polygon mirror 20 in the scanner section 17.

The CPU 91 controls driving of the main motor 96 or the scanner motor 97 according to a program stored in the ROM 92.

The control section 95 controls the image forming section 5 in accordance with an instruction from the CPU 91. Specifically, exposing the surface of the photosensitive drum 28 with components of the scanner unit 17, and the transfer bias for the toner from photosensitive drum 28 to the paper 3 are controlled.

The control unit 90 is provided with a network interface 94 for connecting to an external apparatus such as a personal computer. The CPU 91 controls processing to form the image on the paper 3, according to an image data inputted via the network interface 94.

3. Fixing Unit

The fixing unit will be described below.

Figure 4:
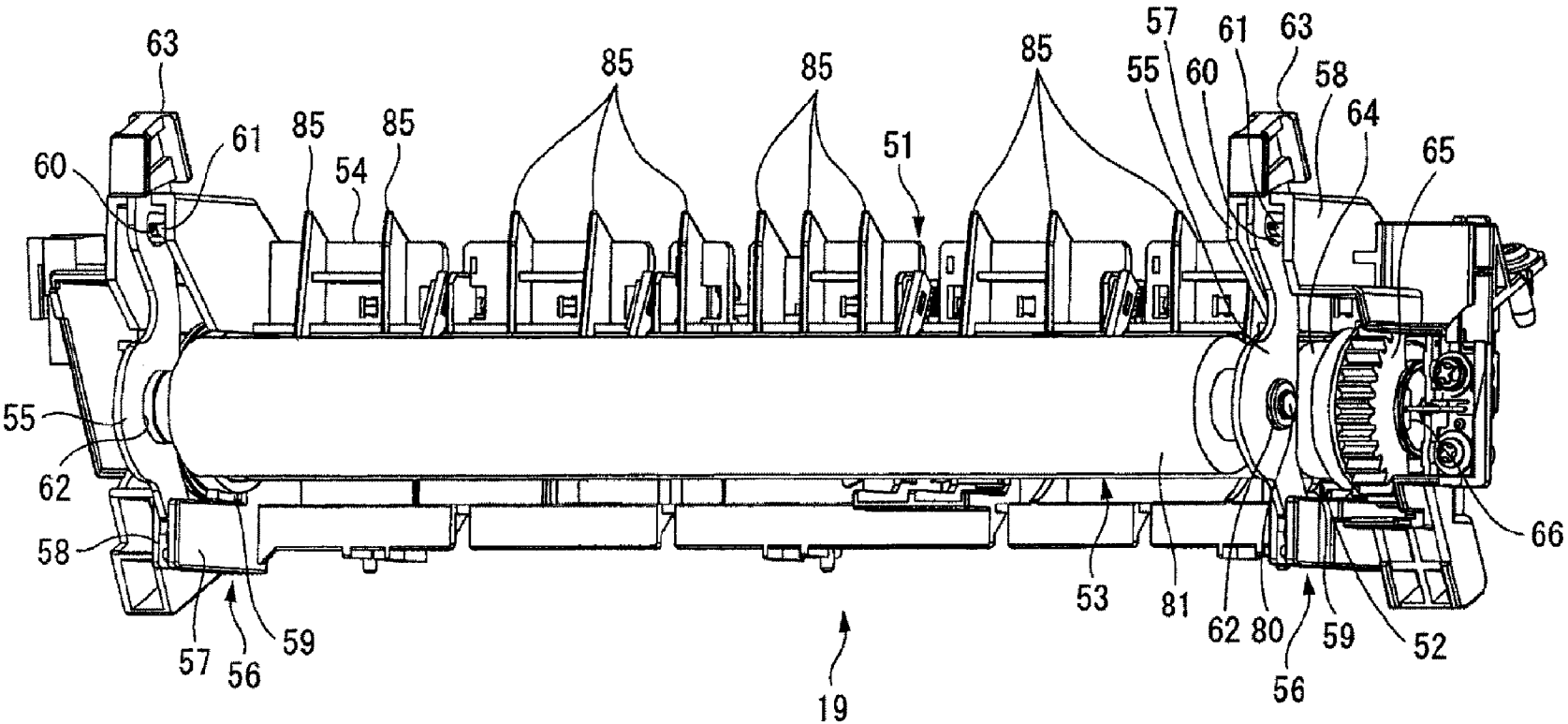
FIG. 4 is a perspective view of a fixing unit from below.

A fixing frame 51 includes a frame main body 54 and a pair of roller support arms 55, as shown in FIG. 4, which is a perspective view of the fixing unit 19 from obliquely below.

Support wall sections 56 projecting downwardly at each end in a lengthwise direction (width direction) and extending in a longitudinal direction orthogonal to the lengthwise direction are formed in the frame main body 54. A plurality of ribs 85 for guiding the upper face of the paper 3 between the support wall sections 56 are formed in the frame main body 54. The ribs are spaced in the lengthwise direction and extends in the direction orthogonal to the lengthwise direction.

Each support wall section 56 includes an inside wall 57 and an outside wall 58 that are opposed with an interval in the lengthwise direction of the frame main body 54. An element tube receiving section 59 for receiving an axial end of a metallic element tube 64 of the heating roller 52 is formed in each inside wall 57 by cutting the lower edge. An engagement shaft 60 which an engaging pawl 61 of each roller support arm 55 engages is spanned at the rear-end between the inside wall 57 and the outside wall 58.

Each roller support arm 55 is disposed between the inside wall 57 and the outside wall 58 of each support wall section 56, and extends in a direction orthogonal to the lengthwise direction of the frame main body 54. Each roller support arm 55 has one end in the lengthwise direction supported rotatably around a shaft (not shown) spanned between the inside wall 57 and the outside wall 58, and includes the engaging pawl 61 capable of engaging the engagement shaft 60 of each support wall section 56 at the other end in the lengthwise direction. A shaft through hole 62 for inserting and supporting rotatably a pressing roller shaft 80 of the pressing roller 53 is formed halfway in the lengthwise direction of each roller support arm 55. Moreover, an operation section 63 operated on engaging/separating the engaging pawl 61 in/from the engagement shaft 60 is provided behind the engaging pawl 61 at the other end of each roller support arm 55 in the lengthwise direction.

The registration roller 13 is disposed at a position in contact with the top of the paper inserted into the manual feed port 7*a* in the laser printer 1, as shown in FIG. 1. The registration roller 13 and the fixing roller 55 are driven in conjunction with the main motor 96 in the illustrative aspect. That is, the main motor 96 is a common driving source for driving the registration roller 13 and the fixing roller 55. Specifically, a driving force of the main motor 96 is transmitted to the registration roller 13 and the fixing roller 55 by a transfer means such as a gear.

Figure 7:
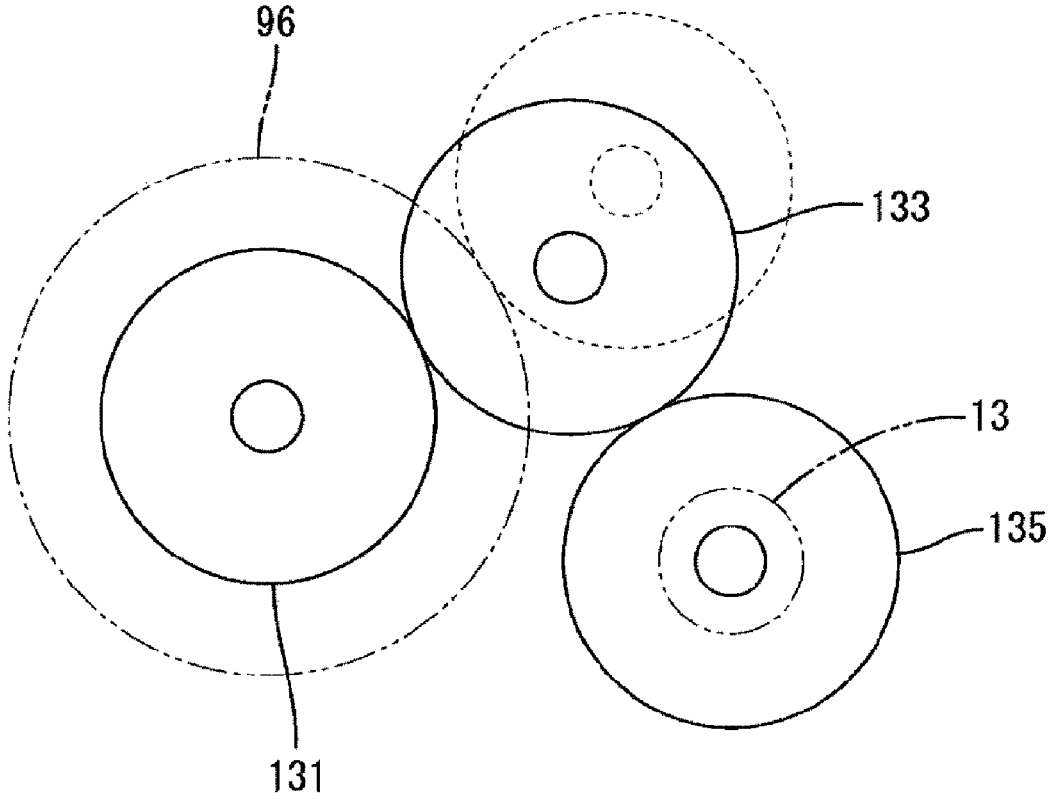
FIG. 7 is an explanatory view of a switching between transmission state and non-transmission state of a registration roller.

FIG. 7 is an explanatory view of a part of the transmitting means. The driving force of the main motor 96 is transmitted to the registration roller 13 by a gear 131 on a drive shaft of the main motor 96, a gear 135 on a shaft of the registration roller 13 and a gear 133 interposed between the gears 131 and 135. A transmission state in which of the driving force can be disconnected from the main motor 96 to the registration roller 13. Specifically, the gear 133 can move between an approaching position (solid line in FIG. 7) of the gears 131, 135 and a separating position (broken line in FIG. 7). A displacement mechanism (not shown) for the gear 133 displaces the gear 133 between the approaching position and the separating position, according to a control signal from the CPU 91. The displacement may take various well-known means. For example, the gear 133 moves between two positions by an actuator driven slidably such as a solenoid under the control of the CPU 91 as transmission switching means. Alternatively, employing a rotatable actuator such as a stepping motor and converting a rotary motion into a linear motion, the gear 133 moves between two positions. In the illustrative aspects the transmission can be disconnected. Another means may be adopted as far as the transmission can be disconnected.

On the other hand, for the fixing roller 55 as shown in FIG. 1, the driving force is always transmitted by a gear mechanism (not shown) during driving of the main motor 96 (FIGS. 3 and 7). That is, the fixing roller 55 always rotates when the main motor 96 rotates, and rotation of the fixing roller 55 always stops when the rotation of the main motor 96 stops. Both the registration roller 13 and the fixing roller 55 are driven by the main motor 96. The transmission to the registration roller 13 can be disconnected under the control since synchronization with the image forming timing is required. However, the transmission to the fixing roller 55 cannot be disconnected. Accordingly, only the registration roller 13 is provided with the transmission switching means. A structure is simpler and cost is lower than transmission switching means provided in both the registration roller and the fixing roller.

The laser printer 1 according to the illustrative aspect is reduced in cost and size, because the registration roller 13 and the fixing roller 55 are driven by the common main motor 96. However, if the registration roller 13 is driven in an early stage, the fixing roller 55 a heating of which is insufficient is driven, the fixing roller 55 has a problem due to the low temperature, such as a large torque by driving where the developer is not molten and a deterioration of a thermistor 105. If the registration roller 13 is driven after waiting until the temperature reaches to a fixing temperature, paper inserted into the manual feed port 7*a* is not held by the registration roller 13, and due to long waiting time the apparatus is less convenient.

Thus, in the illustrative aspect, the temperature of the fixing roller 55 is detected, and whether the temperature reaches a second temperature S2 higher than the melting point of the toner is judged. If the temperature of the fixing roller 55 reaches the second temperature S2 after a paper in the manual feed port 7*a* is detected, the registration roller 13 is driven by the main motor 96 when the temperature of the fixing roller 55 does not reach a first temperature S1 capable of forming an image, and the registration roller 13 holds the paper.

Figure 5:
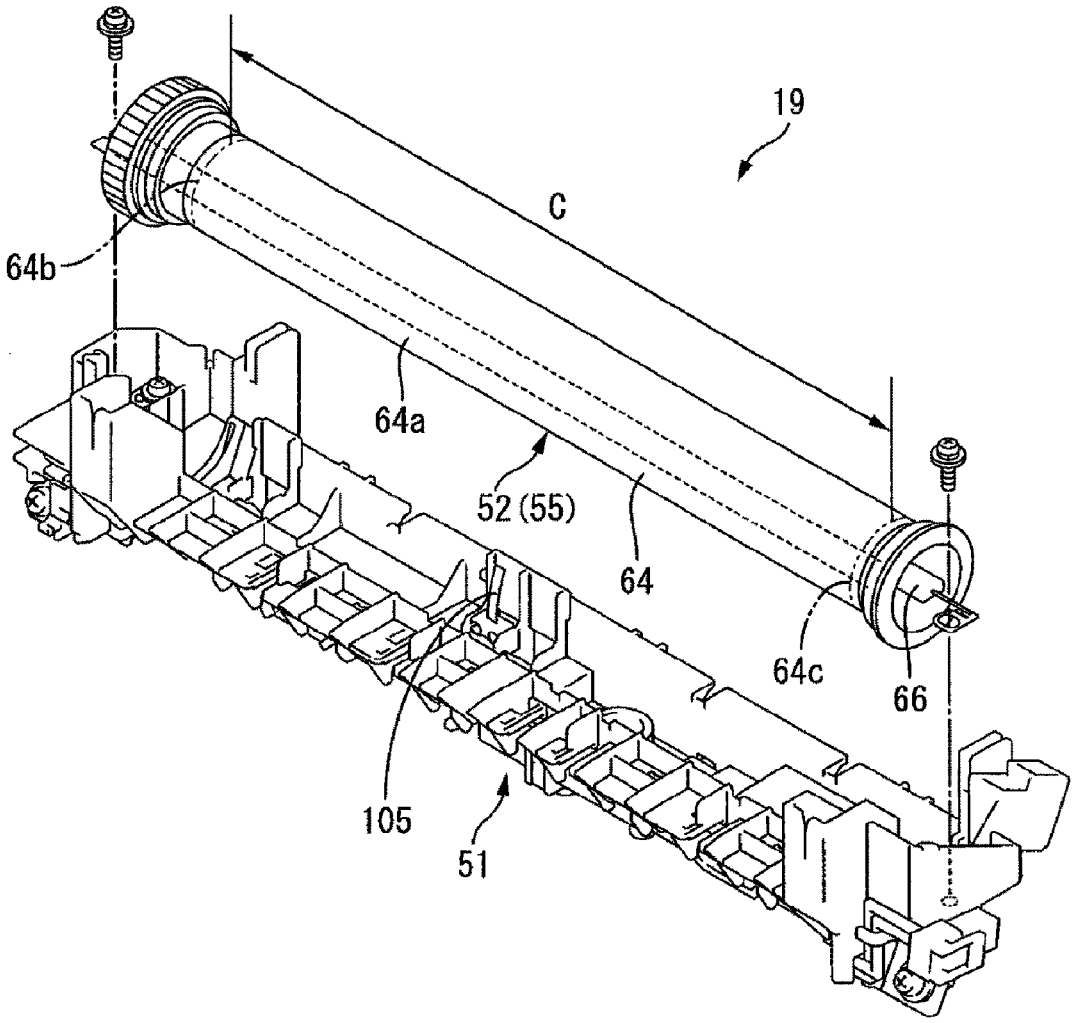
FIG. 5 is an exploded perspective view of a part of the fixing unit from above.

A manual feed detector 103 for detecting the paper inserted into the manual feed port 7*a* is provided near the manual feed port 7*a*, as shown in FIG. 1. On the other hand, the fixing unit 19 is provided with a thermistor 105 for detecting the temperature of the fixing roller 55, as shown in FIG. 5. In the illustrative aspect, a part of a surface of the metallic element tube 64 of the heating roller 52 is a contact section 64*a* contacting a portion where an image is formed on the paper, i.e. the toner image is transferred on the paper, and the thermistor 105 is opposed to the contact section 64*a*. The contact section 64*a* corresponds to a portion in an image formation area in the metallic element tube 64, i.e. an area C where an image is formed in the width direction). In FIG. 5, the end of the portion corresponding to the image formation area in the metallic element tube 64 is indicated by double-dot dashed lines 64*b*, 64*c*, and a portion between them corresponds to the contact section 64*a*.

Figure 6:
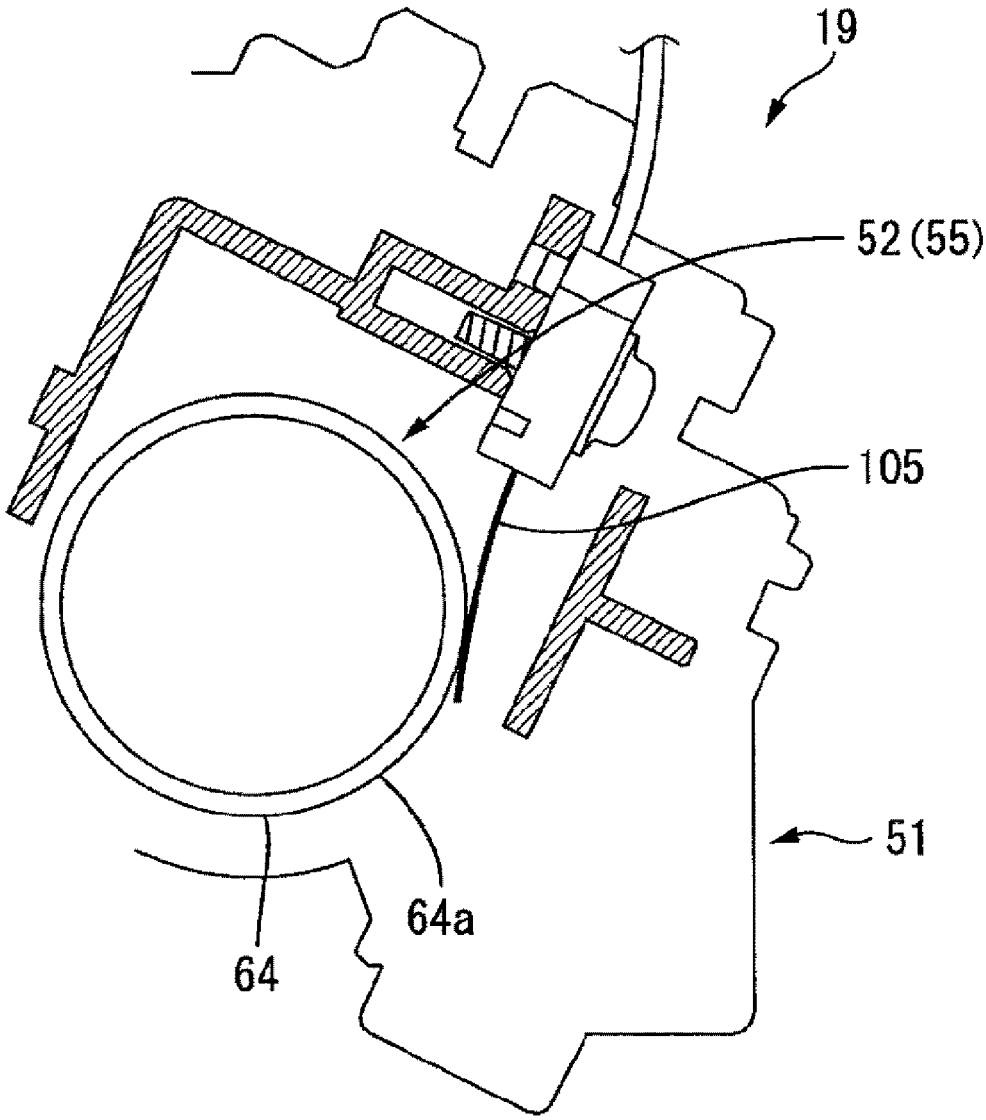
FIG. 6 is a cross-sectional view of an essential part of a heating roller.

The thermistor 105 detects the surface temperature of the metallic element tube 64 by partly contacting the surface of the metallic element tube 64 of the heating roller 52, as shown in FIG. 6. The manual feed detector 103 and the thermistor 105 are included in the detection section 100, and a signal of each detector is inputted directly or indirectly via an A/D converter into the control unit 95.

If the paper is detected by the manual feed detector 103 as shown in FIG. 1, the CPU 91 judges whether the temperature detected by the thermistor 105 reaches the second temperature S2 higher than the melting point of the toner (FIG. 3). If the second temperature S2 is reached, the registration roller 13 is driven by the main motor 96 when the detected temperature is lower than the first temperature S1 capable of forming an image, i.e. before the temperature of the fixing roller 55 reaches the first temperature S1, and the registration roller 13 holds the paper.

The registration roller 13 is driven when the temperature of the fixing roller 55 reaches the melting temperature of the toner before reaches the fixing temperature, and holds the paper. Accordingly, the waiting time is reduced, and if the fixing roller 55 is driven in conjunction with the registration roller 13, the developer is molten at the driving time. The above problem by the low temperature drive is solved. Accordingly, the apparatus is convenient while cost and size are reduced.

In the illustrative aspect, since it is judged whether the temperature of the fixing roller 55 reaches the second temperature S2 based on a detection result of the thermistor 105, the temperature of the fixing roller 55 is measured precisely. Since temperature to start driving is set to the melting point, the driving of the fixing roller 55 is effectively started, although if a temperature error is large, the fixing roller 55 starts to be driven before the temperature of the fixing roller reaches the melting point.

As described above, since the thermistor 105 is opposed to the contact section 64*a*, a precise temperature of the contact section 64*a* is detected. On the contrary, the toner is likely to adhere to the thermistor 105, and the problem in driving the fixing roller 55 at low temperatures is severe. However, in the illustrative aspect, the fixing roller 55 is driven after a precise temperature is detected, and the problem by the low temperature drive is prevented effectively.

Since the thermistor 105 is disposed in contact with a surface of the fixing roller 55, the temperature of the fixing roller 55 is detected more precisely. On the contrary, the thermistor 105 and the fixing roller 55 are likely to be bonded via the toner, and when the fixing roller 55 is driven at low temperatures, the thermistor 105 maybe deteriorated. However, since the fixing roller is driven after a temperature of the toner reaches the melting point, the fixing roller is not driven when the thermistor 105 and the fixing roller 55 are bonded, and the precise temperature of the fixing roller is detected to effectively solve the above problem.

4. Processing Flow

Figure 8:
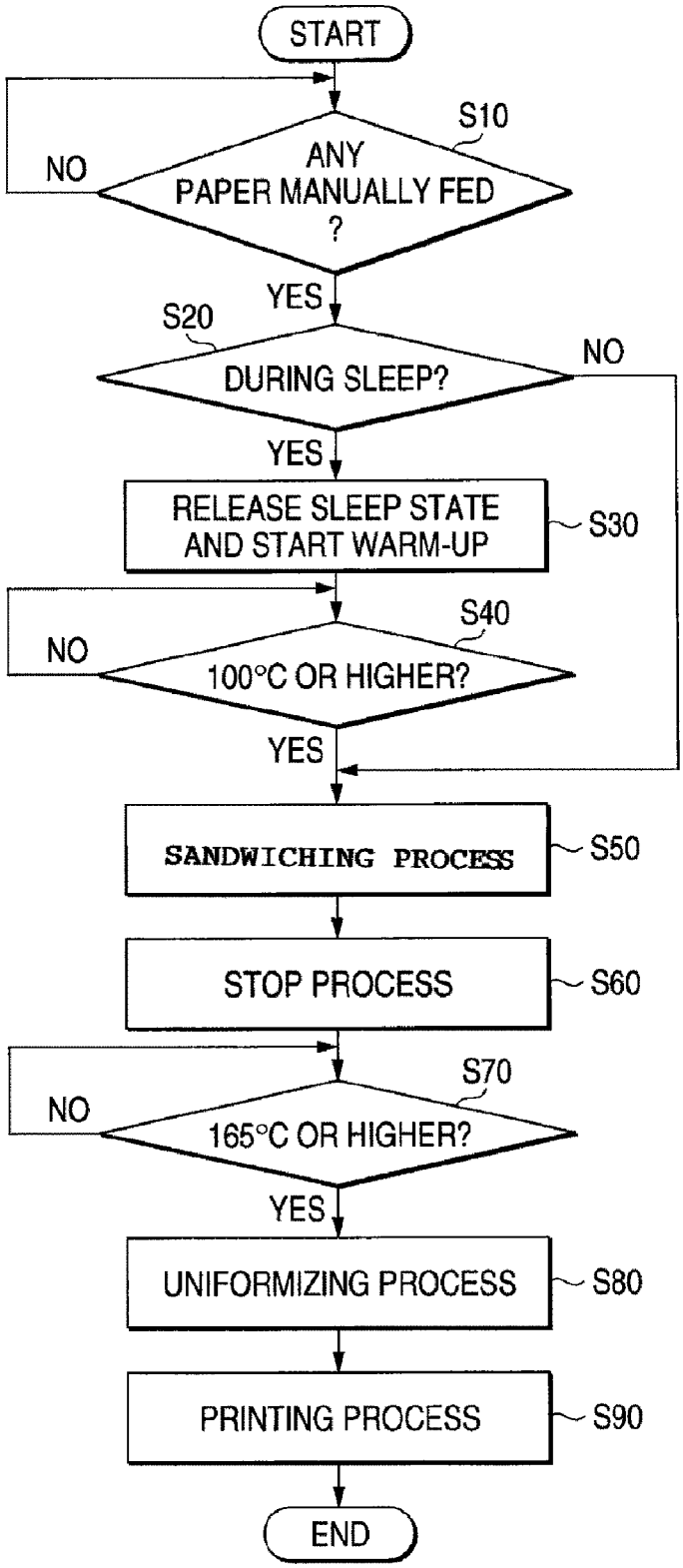
FIG. 8 is a flowchart illustrating a printing process including the manual feed.
Figure 9:
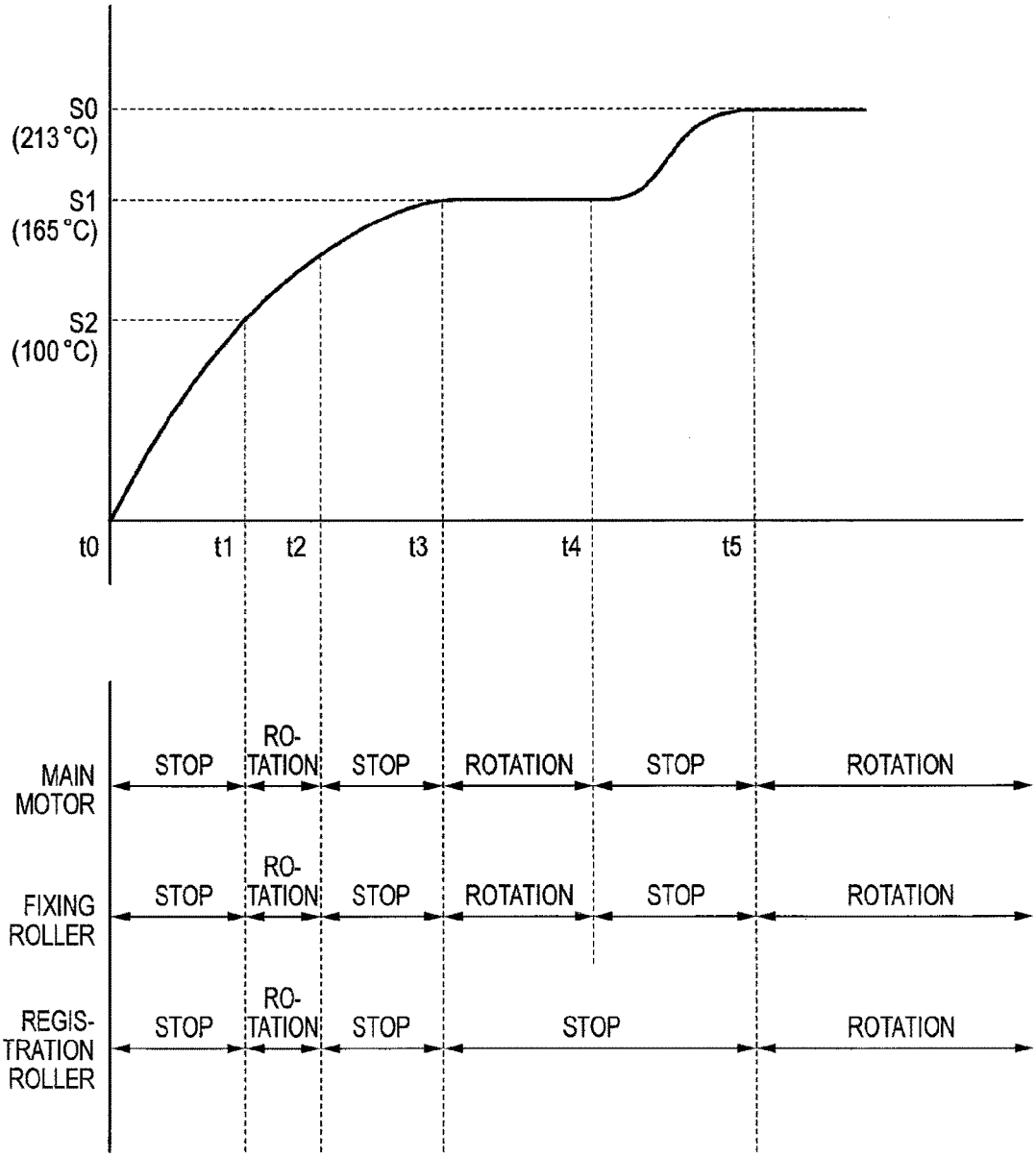
FIG. 9 is an explanatory view for relation between driving state of the main motor, the fixing roller and the registration roller and the temperature of the fixing roller.

Referring to FIGS. 8 and 9, processing flow will be described below. FIG. 8 is a flowchart showing a process for printing by manual feed, and a first graph of FIG. 9 represents a relation between the temperature of the fixing roller 55 and time, and a second graph of FIG. 9 is an explanatory view for relation between driving of the main motor 96, the fixing roller 55 and the registration roller 13 and the time.

As shown in FIG. 8, a paper into the manual feed port 7*a* is inserted, the manual feed detector 103 detects the paper. If the paper is detected by the manual feed detector 103, answer at S10 is Yes, and it is judged at S20 whether the laser printer 1 is in a sleep mode. That is, in the laser printer 1 according to the illustrative aspect, if nothing is printed for a certain period since the last printing, the sleep mode is set, i.e. the heating of the fixing roller 55 stops. At S20, when the paper is detected by the manual feed detector 103, it is judged whether the laser printer is set in the sleep mode.

If the laser printer is set in the sleep mode, the answer at S20 is Yes. At S30, the sleep state is released, the halogen lamp 66 is turned on, and a warm-up is started (S30). Thereafter, it is judged at S40 whether the temperature of the fixing roller 55 reaches the second temperature S2 (100° C.). If the second temperature is reached, the answer at S40 is Yes, and performs a holding process (S50). Since the paper is detected by the manual feed detector 103 until the holding process, i.e. the temperature of the fixing roller 55 reaches 100° C. (from t0 to t1 in FIG. 9), the main motor 96, the fixing roller 55 and the registration roller 13 are stopped. In the holding process, the registration roller 13 is driven to hold a part of the paper (from t1 to t2 in FIG. 9), and the main motor 96, the fixing roller 55 and the registration roller 13 are rotated. Further, after the holding process, a stop process (S60) for stopping the driving of the main motor 96 is performed (from t2 to t3 in FIG. 9), and the driving of the main motor 96, the fixing roller 55 and the registration roller 13 is stopped. By the heating of the halogen lamp 66, the temperature of the fixing roller 55 rises, as shown in FIG. 9.

Returning to FIG. 8, after S60, it is judged whether the temperature of the fixing roller 55 reaches the first temperature (165° C.) (S70). If the temperature reaches the first temperature, the registration roller 13 is put in a non-driven state (broken line in FIG. 7), and a uniformizing process on the fixing roller 55 is performed (S80) (from t3 to t4 in FIG. 9), and the fixing roller 55 is kept roughly at the first temperature S1 and rotated while the registration roller 13 is stopped. If the warm-up is ended, a printing process is performed (a transfer process for the toner on the paper and a fixing process) (S90). In FIG. 9, the printing process is performed after t5. In the printing process, the toner is fixed onto the paper at a fixing temperature S0 (213° C.) higher than the first temperature S1.

In the illustrative aspect, after the paper is held by the registration roller 13, the driving of the registration roller 13 and the fixing roller 55 by the main motor 96 is stopped. After a period for heating the fixing roller 55 by the halogen lamp 66, the registration roller 13 is put in a non-transmission state and the driving of the fixing roller 55 is started.

The driving of the registration roller 13 and the fixing roller 55 is stopped for the period for heating the fixing roller 55 from t2 to t3 after the paper is held by the registration roller 13, as shown in FIG. 9. The fixing roller 55 is rotated at an enough temperature. Accordingly, the temperature of the fixing roller 55 is uniform, while a drive period for the fixing roller 55 to uniformize is shortened, deterioration of the fixing roller 55 is prevented, and the life of apparatus is extended.

The CPU 91 can switch between a first mode where the temperature of the fixing roller 55 is maintained at the first temperature S1, and a second mode where the temperature of the fixing roller 55 is not maintained at the first temperature S1 (FIG. 3). In the second mode at S20 as shown in FIG. 8, the holding process for driving the registration roller 13 is performed (S50), as the temperature of the fixing roller 55 reaches the second temperature S2, and the stop process (S60), the uniformizing process (S80), and the printing process (S90) are performed.

The invention is not limited to the above illustrative aspect as described with reference to the drawings, but the following illustrative aspect may be included in the technical scope of the invention, and various changes may be made without departing from the scope or spirit of the invention.

(1) Though in the above illustrative aspect, the first temperature and the second temperature are judged by directly measuring the temperature of the fixing roller 55 using the thermistor 105, any other structure may be taken as far as the temperature of the fixing roller 55 is obtained. For example, a precision may be lower than the direct measurement by the thermistor 105, but if a heating time by a heating means correlates with the temperature of the fixing roller 55, the temperature of the fixing roller 55 can be indirectly obtained, based on the heating time. (2) In the illustrative aspect, one of a pair of fixing rollers 55 is the heating roller 52, and the other is unheated roller, but both the rollers may be heated. In The case, the first temperature and the second temperature may be judged, based on the temperature of any one roller. That is, if the temperature of any one roller reaches the second temperature, the registration roller 13 maybe driven to hold the paper.

What is claimed is:

1. An image forming apparatus comprising:

a fixing roller to fix a developer onto a recording medium;

a heating unit to heat the fixing roller;

a manual feed roller that is disposed at a position contact with a top end of the recording medium inserted into a manual feed port, and is capable of holding and feeding the recording medium;

a common driving unit that drives the fixing roller and the manual feed roller together when driving the manual feed roller;

a judgment unit to judge whether a temperature of the fixing roller is lower than a first temperature capable of starting image formation and reaches a second temperature higher than a melting point of the developer;

a detection unit to detect whether the recording medium is inserted into the manual feed port;

a control unit to control the driving unit to drive the manual feed roller to hold the recording medium by the manual feed roller if the recording medium is detected by the detection unit and the judgment unit judges that the temperature of the fixing roller reaches the second temperature; and a transmission switching unit to switch between a transmission state in which a driving force is transmitted from the driving unit to the manual feed roller and a non-transmission state in which no driving force is transmitted, wherein the fixing roller can be driven and rotated by the driving unit in the non-transmission state under the control of the control unit.

2. The image forming apparatus according to claim 1, wherein the drive control unit controls the drive unit to stop driving of the manual feed roller and the fixing roller after the manual feed roller holds the recording medium, and to start driving of the fixing roller in the non-transmission state after keeping a period for heating the fixing roller by the heating unit.

3. The image forming apparatus according to claim 1, farther comprising:

a temperature detection unit to detect the temperature of the fixing roller, wherein the judgment unit judges whether the temperature of the fixing roller reaches the second temperature, based on a detection result by the temperature detection unit.

4. The image forming apparatus according to claim 3, wherein a part of a surface of the fixing roller is made as a contact part contacting a portion where an image is formed on the recording medium, and the temperature detection unit is disposed to be opposed to the contact part.

5. The image forming apparatus according to claim 1, wherein the temperature detection unit is disposed in contact with a surface of the fixing roller.

6. The image forming apparatus according to claim 1, further comprising:

a mode switching unit to switch between a first mode in which the temperature of the fixing roller is maintained at the first temperature by the heating unit and a second mode in which the temperature of the fixing roller is not maintained at the first temperature, wherein the judgment unit judges that the fixing roller reaches the second temperature, if the first mode is set.

* * * * *